US010451230B2

(12) United States Patent
Patel et al.

(10) Patent No.: US 10,451,230 B2
(45) Date of Patent: Oct. 22, 2019

(54) WALL MOUNT LIGHT FIXTURE

(71) Applicant: Hubbell Incorporated, Shelton, CT (US)

(72) Inventors: Dhavalkumar Patel, Greer, SC (US); Tom Veltri, Simpsonville, SC (US); David Rector, Mauldin, SC (US); Seng Vang, Piedmont, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/496,671

(22) Filed: Apr. 25, 2017

(65) Prior Publication Data

US 2017/0307152 A1 Oct. 26, 2017

Related U.S. Application Data

(60) Provisional application No. 62/326,902, filed on Apr. 25, 2016.

(51) Int. Cl.

| | |
|---|---|
| ***F21S 8/00*** | (2006.01) |
| ***F21V 3/02*** | (2006.01) |
| ***F21V 23/00*** | (2015.01) |
| ***F21V 17/10*** | (2006.01) |
| ***F21V 19/00*** | (2006.01) |
| *F21Y 115/10* | (2016.01) |

(52) U.S. Cl.

CPC ..... *F21S 8/033* (2013.01); *F21V 3/02* (2013.01); *F21V 17/10* (2013.01); *F21V 19/003* (2013.01); *F21V 23/009* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2,906,863 | A | 9/1959 | Ritter | |
| 2004/0213003 | A1 | 10/2004 | Lauderdale et al. | |
| 2005/0090124 | A1 | 4/2005 | Mohacsi et al. | |
| 2007/0274084 | A1 | 11/2007 | Kan et al. | |
| 2007/0285930 | A1 | 12/2007 | Chen | |
| 2010/0103672 | A1 | 4/2010 | Thomas et al. | |
| 2013/0044475 | A1 | 2/2013 | Hutchens | |
| 2014/0146542 | A1 | 5/2014 | Seward et al. | |
| 2014/0268720 | A1* | 9/2014 | Dungan | F21V 23/026 362/218 |

(Continued)

OTHER PUBLICATIONS

PCT/US2017/029361 International Search Report and Written Opinion dated Jul. 6, 2017 (14 pages).

*Primary Examiner* — Ashok Patel

(74) *Attorney, Agent, or Firm* — Michael Best & Friedrich, LLP

(57) ABSTRACT

A wall mounted light fixture includes a body at least partially defining a housing. The body has a first side facing an interior of the housing and a second side facing the exterior of the housing. The first side of the body has a plurality of front connecting features and the second side of the body has a plurality of rear connecting features. A light emitter is positioned in the interior of the housing and supported by the first side of the body. A lens is connected to at least one of the front connecting features. A mounting component is connected to at least one of the rear connecting features.

20 Claims, 20 Drawing Sheets

(56) References Cited

U.S. PATENT DOCUMENTS

| | | | | |
|---|---|---|---|---|
| 2014/0268752 | A1* | 9/2014 | Werr | F21S 4/008<br>362/235 |
| 2015/0338053 | A1* | 11/2015 | Rector | F21V 5/02<br>362/224 |

* cited by examiner

WALL MOUNT LIGHT FIXTURE

RELATED APPLICATION(S)

This application is based on U.S. provisional application Ser. No. 62/326,902, filed Apr. 25, 2016, the disclosure of which is incorporated herein by reference in its entirety and to which priority is claimed.

FIELD

Various exemplary embodiments relate to wall mounted light fixtures.

BACKGROUND

Light fixtures, or luminaires, are used with electric light sources to provide aesthetic and functional housing in both interior and exterior applications. One type of light fixture is a wall mounted light fixture. Wall mounted lighting fixtures are positioned along walls and provide lighting for a space, such as a building or room. Different users can have different design requirements based on location and desired light output.

Recently, lighting fixtures have begun using light emitting diodes (LEDs) as a light source. The use of LEDs comes with unique light distribution and thermal management requirements. For example, the use of multiple LEDs can result in pixelated points of light that are aesthetically unpleasing.

SUMMARY

According to an exemplary embodiment, a wall mounted light fixture includes a body at least partially defining a housing. The body has a first side facing an interior of the housing and a second side facing the exterior of the housing. The first side of the body has a plurality of front connecting features and the second side of the body has a plurality of rear connecting features. A light emitter is positioned in the interior of the housing and supported by the first side of the body. A lens is connected to at least one of the front connecting features. A mounting component is connected to at least one of the rear connecting features.

According to another exemplary embodiment, a wall mounted light fixture includes a body at least partially defining a housing. The body has a first side facing an interior of the housing and a second side facing the exterior of the housing. The first side of the body has a plurality of front connecting features and the second side of the body has a plurality of rear connecting features. A mounting bracket is connected to at least one of the front connecting features. A light emitter is connected to the mounting bracket. An end cap is connected to the body. A front lens is connected to the end cap and positioned substantially opposite from the body.

According to another exemplary embodiment, a wall mounted light fixture includes a body at least partially defining a housing. The body has a first side facing an interior of the housing and a second side facing the exterior of the housing. The first side of the body has a plurality of front connecting features and the second side of the body has a plurality of rear connecting features. A light emitter is positioned in the interior of the housing and supported by the first side of the body. An end cap is connected to the body. A front lens is connected to the end cap and positioned substantially opposite from the body. The front lens includes an upper section, a lower section, and a panel removably positioned between the upper section and the lower section.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
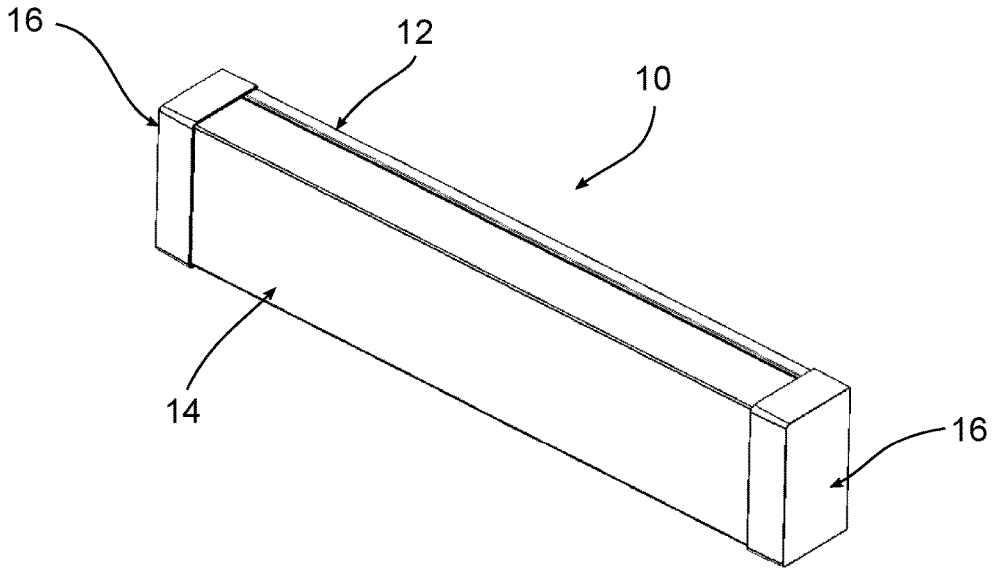
FIG. 1 is a front perspective view of an exemplary light fixture.
Figure 2:
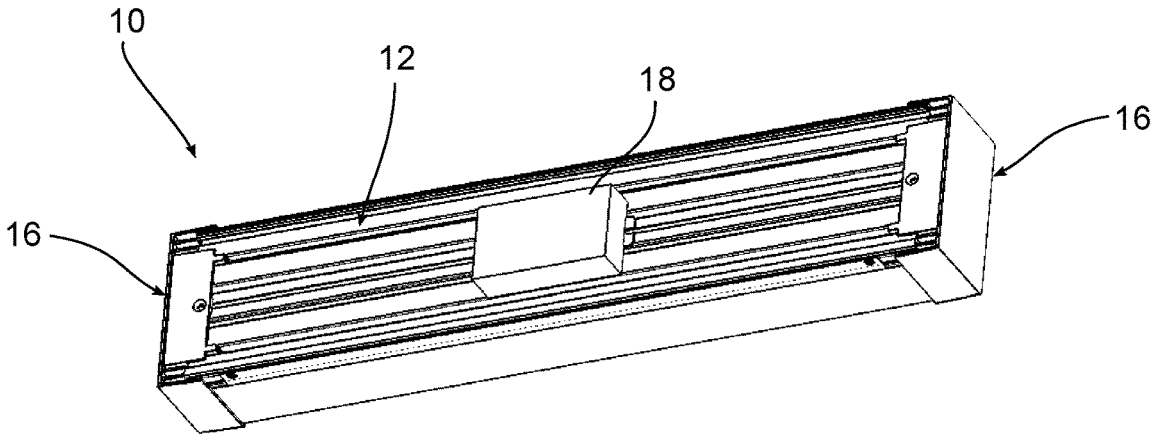
FIG. 2 is a rear perspective view of FIG. 1.
Figure 3:
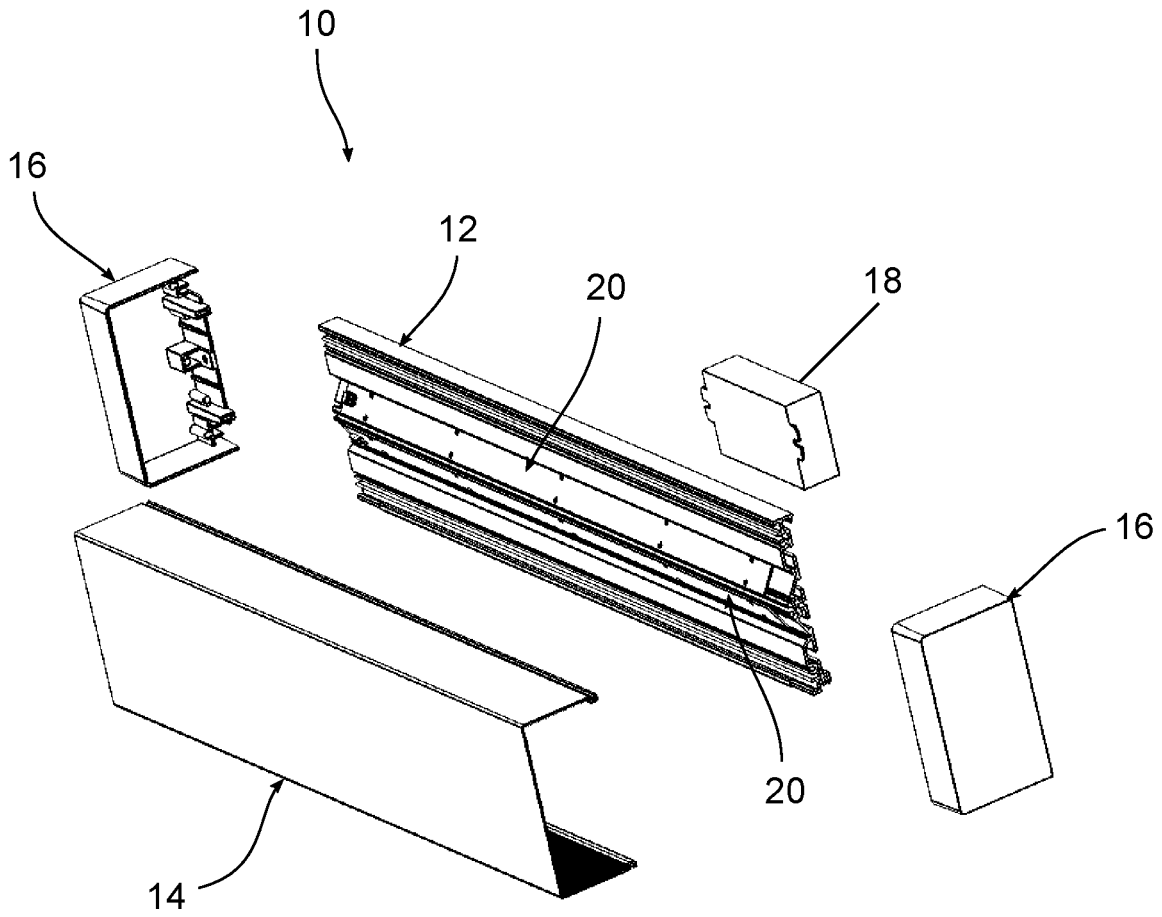
FIG. 3 is an exploded view of FIG. 1.

FIGS. 1-3 show an exemplary wall mounted light fixture 10, although the features described herein can be incorporated into other light fixtures. The light fixture 10 may be recessed or surface mounted and is electrically connected to a power source (not shown), such as a mains power supply in a building. The light fixture 10 can be positioned to direct light to a specific area of a room, for example a outwardly from the wall and/or also from the top and bottom of the light fixture 10.

According to an exemplary embodiment, the light fixture 10 includes a body 12, a lens 14, and a pair of end caps 16. The lens 14 and the end caps 16 are connected to the body 12. The configuration of the lens 14 can vary to achieve a desired light output. For example, the lens 14 can have different levels of opacity and different optical features, such as serrations or prisms, to provide different light diffusion. A driver compartment 18 is connected to the rear of the body 12. One or more light emitters 20 can be connected to the body 10 to emit light through the lens 14 and the end caps 16. The light emitters 20 can include a plurality of light emitting diodes (LEDs) connected to a printed circuit board (PCB). The size, number, placement, color, and orientation of the LEDs can be varied to achieve a desired light output.

Figure 4:
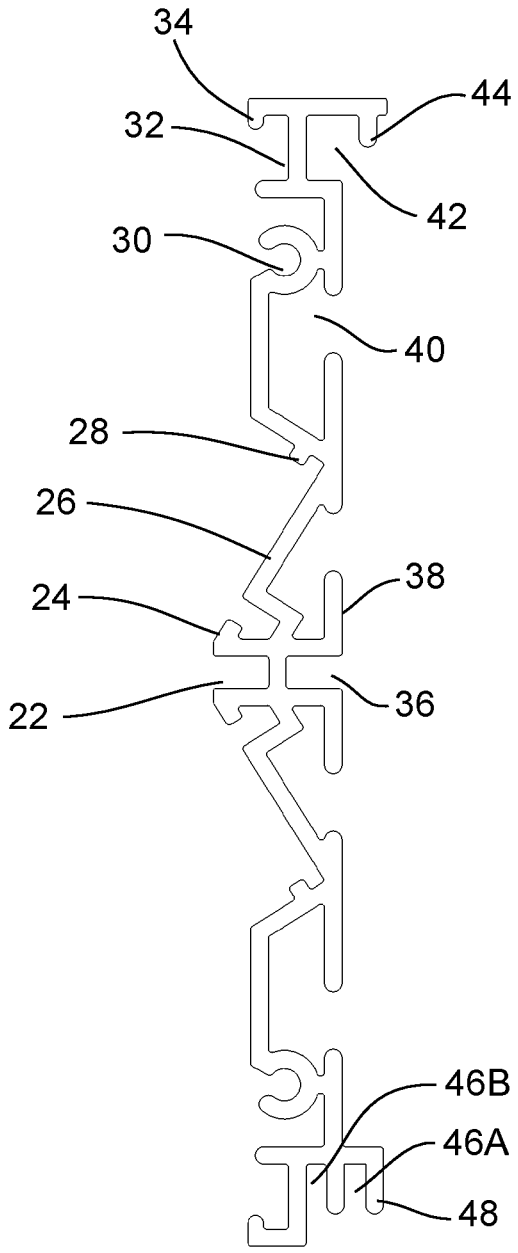
FIG. 4 is a side view of the body member of FIG. 1.
Figure 5:
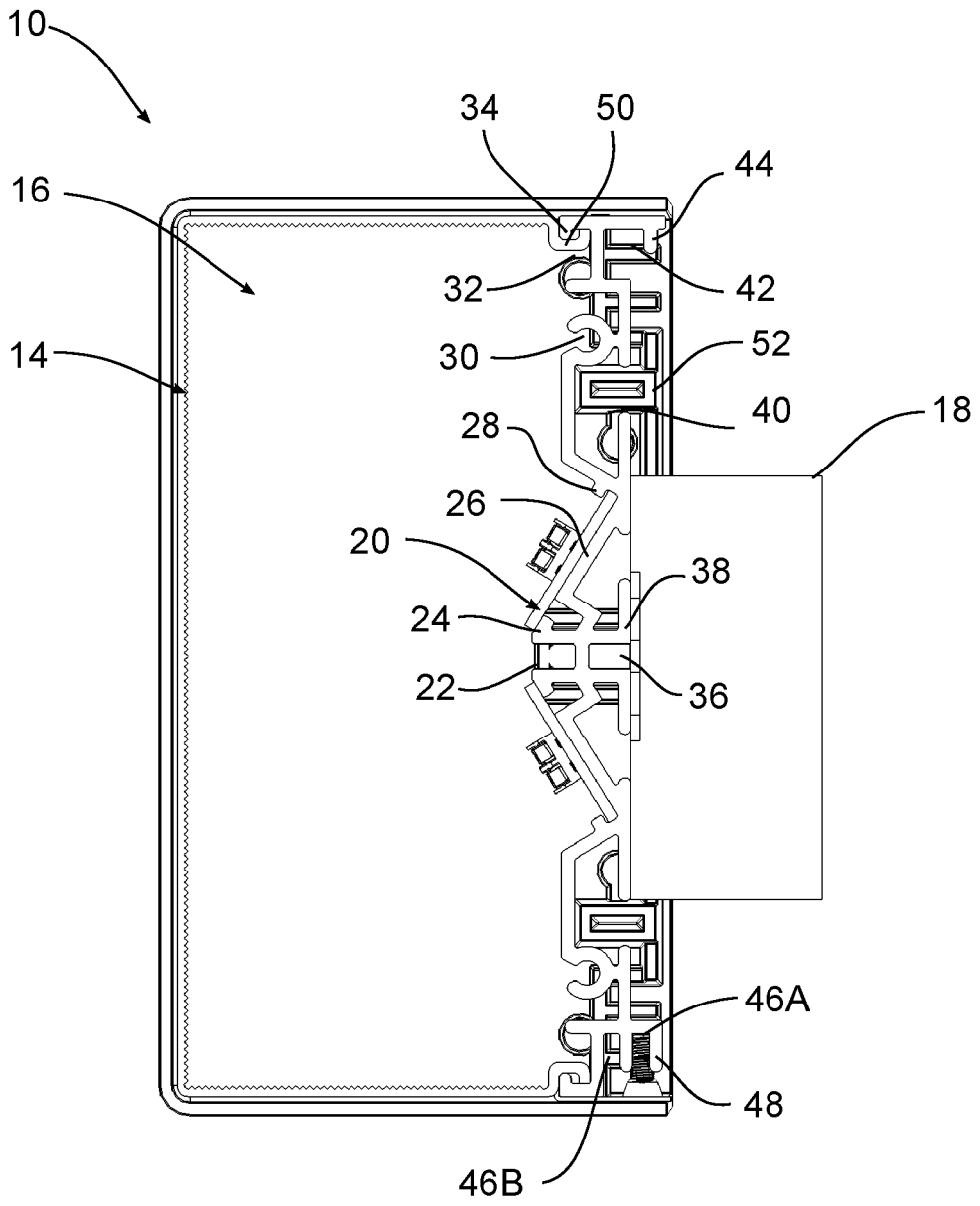
FIG. 5 is a side view of FIG. 1 with one of the end caps removed.

As best shown in FIGS. 4 and 5, the body 12 includes a plurality of connecting features to receive various components. For example, the body 12 has front connecting features including a front central channel 22 that can receive fasteners, for example screws, snap-fit connections, and interference fit connections. A set of angled front tabs 24 extend from the front channel 22 that combine with angled mounting surfaces 26 for receiving a light emitter 20. The light emitter 20 can be further held in place by mounting tabs 28. One or all of the mounting surfaces 22, 24 can receive light emitters to provide different light outputs. A cylindrical channel 30 defined by a substantially C-shaped member is provided for receiving fasteners. A front upper channel 32 is at least partially defined by a front hook member 34 that receives the lens 14. The front connecting features can be substantially symmetrical, about the center channel 22 and only the upper features are labeled in the drawings, although other configurations can also be used.

Rear connecting features can include a central rear channel 36 that can receive fasteners, for example to connect the driver compartment 18. Tabs 38 extend from the rear channel 36 to provide support to the driver compartment 18. A mid rear channel 40 is positioned above the central rear channel 36. A rear upper channel 42 is at least partially defined by a rear hook member 44. An outer rear lower channel 46A is defined by a pair of arms 48 and can be configured to receive a fastener. An inner rear lower channel 46B is partially defined by one of the arms 48. Different sizes, shapes, and configurations of body members 12 can also be used depending on the size of the light fixture and the desired connection components. Different adaptor plates or brackets can also be connected to the body 12 to provide different light emitter mounting surfaces at different angles or orientations.

Figure 6:
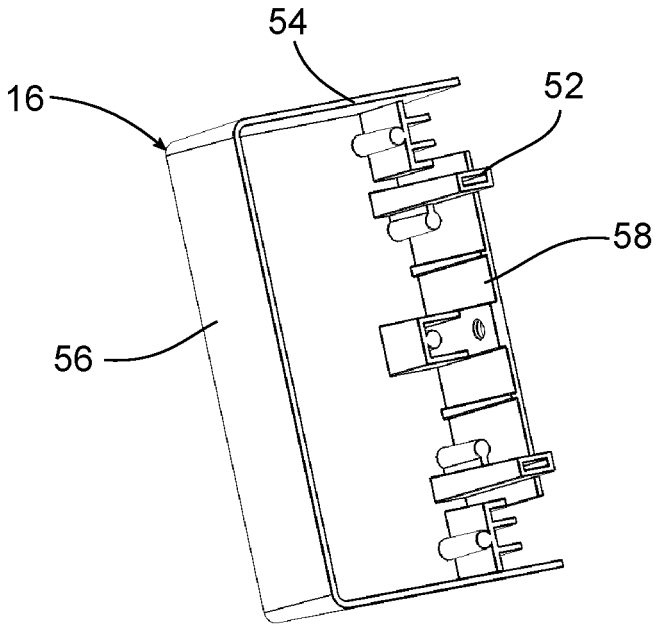
FIG. 6 is a front perspective view of the end cap of FIG. 1.
Figure 7:
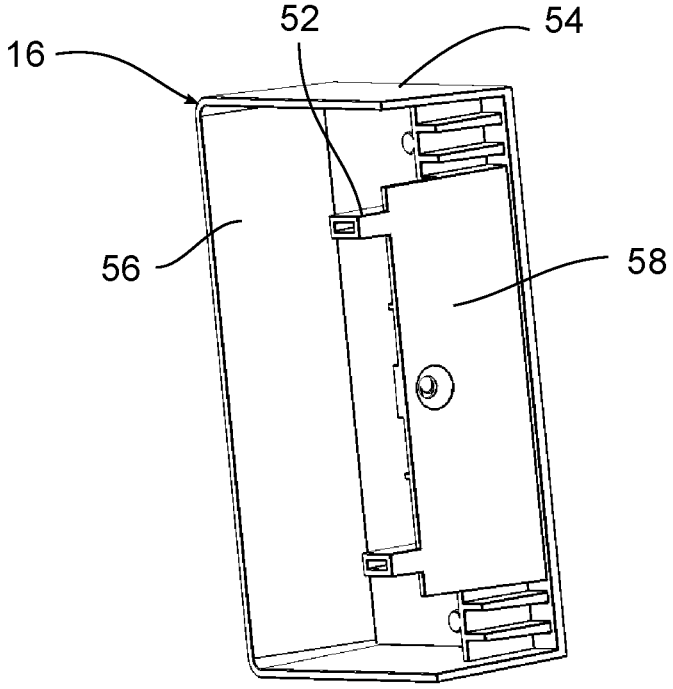
FIG. 7 is a rear perspective view of FIG. 6.

FIG. 5 shows that the lens 14 includes upper and lower lens hooks 50 that are positioned in the front upper channel 32 and connected to the front hooks 34 and that the end cap 16 includes a set of wedge protrusions 52 that extend into the rear mid channels 40. As best shown in FIGS. 6 and 7, the end cap 16 includes a side edge 54, a front edge 56, and a rear edge 58. The wedge 52 protrusions have a wider base and taper to a terminal end that forms an interference fit with the body 12. An aperture is provided in the rear edge 58 to receive a fastener that can secure the end caps 16 to the body 12. A number of other protrusions extend from the side edge 54 to help space the end cap 16 properly from the body 12.

Figure 8:
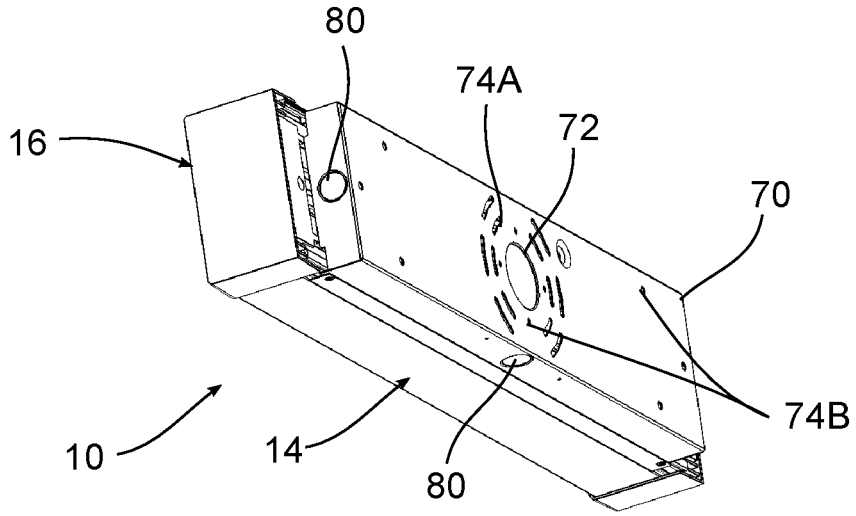
FIG. 8 is a rear perspective view of the luminaire of FIG. 1 connected to a surface mount.
Figure 9:
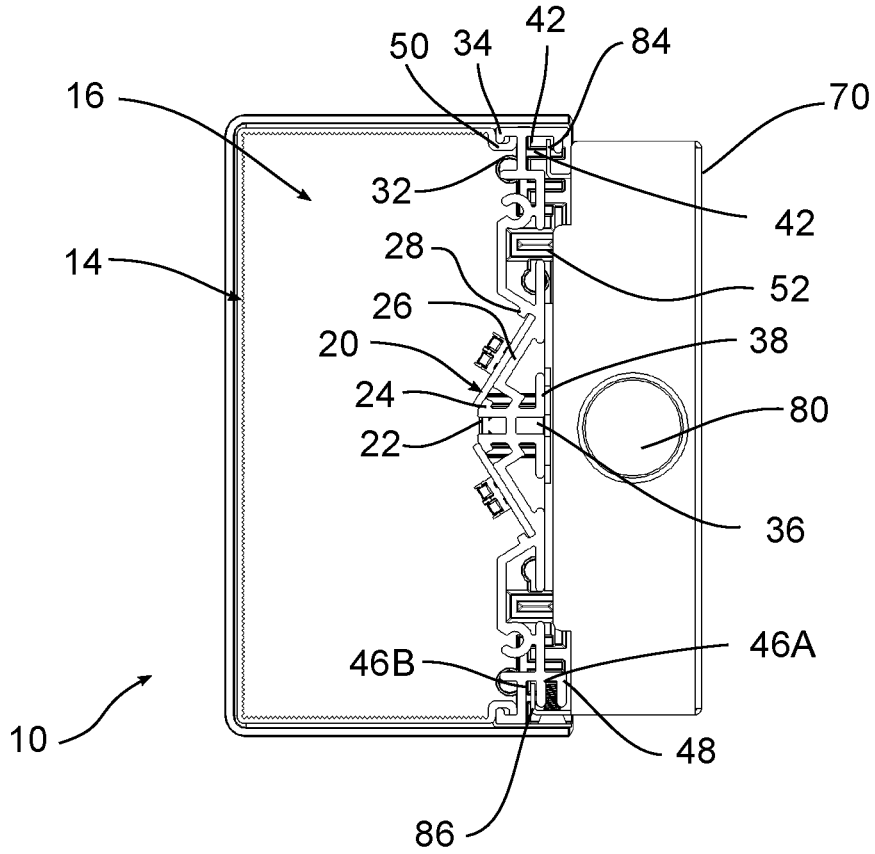
FIG. 9 is a side view of FIG. 8 with one of the end caps removed.
Figure 10:
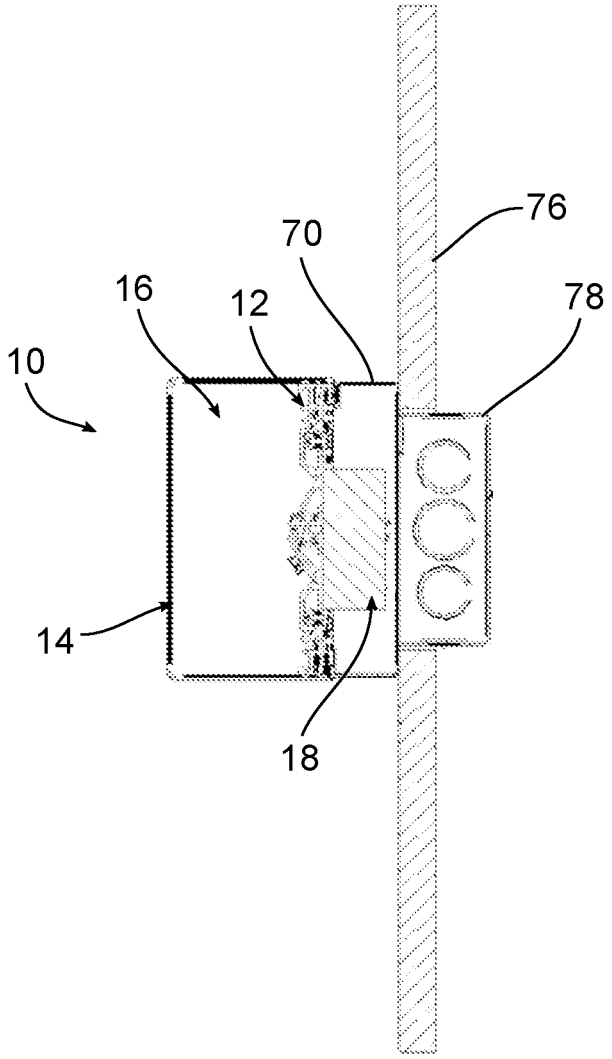
FIG. 10 is a side view of the light fixture and surface mount of FIG. 8 installed in a wall.

The light fixture 10 can be mounted to a surface, such as a wall, in a number of different ways. FIGS. 8-10 show an exemplary embodiment of a surface mount configuration. A surface mount 70 includes a rear surface with a central opening 72 that can allow conductors to be passed through the rear wall. The rear wall also includes a plurality of mounting slots 74A and mounting openings 74B that facilitate connecting the surface mount 70 to a surface 76 such as a wall or wall stud and to a junction housing 78. Knock-outs 80 are provided in side, top, and bottom walls that can be removed to provide conduits for conductors. A bottom plate 82 can be connected to the body 12 and the surface mount 70 to eliminate any gaps therebetween.

As best shown in FIGS. 9 and 10, the surface mount 70 includes a top flange 84 and a bottom flange 86. Both the top and bottom flanges 84, 86 can have a substantially L-shaped configuration with a free end facing upward. The top flange 84 extends into the rear upper channel 42. The bottom flange 86 extends into the inner rear lower channel 46B. During installation, the surface mount 70 can be connected to a surface 76, with the central opening 72 aligned with the opening of a junction box or otherwise providing access to a power supply. After the surface mount 70 is secured to the surface 76, electrical connections can be made and the body 12 can be engaged with the surface mount 70 by hanging the rear upper channel 42 and the inner rear lower channel 46B from the top flange 84 and the bottom flange 86 respectively. A fastener can then be inserted through the surface mount 70 and into the outer rear lower channel 46A. When connected, the driver compartment 18 will extend into the surface mount 70.

Figure 11:
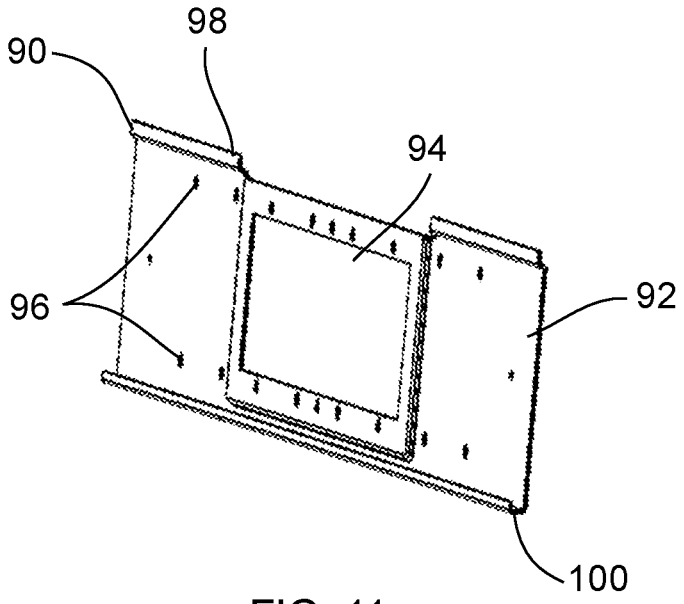
FIG. 11 is a front perspective view of a recessed mount.
Figure 12:
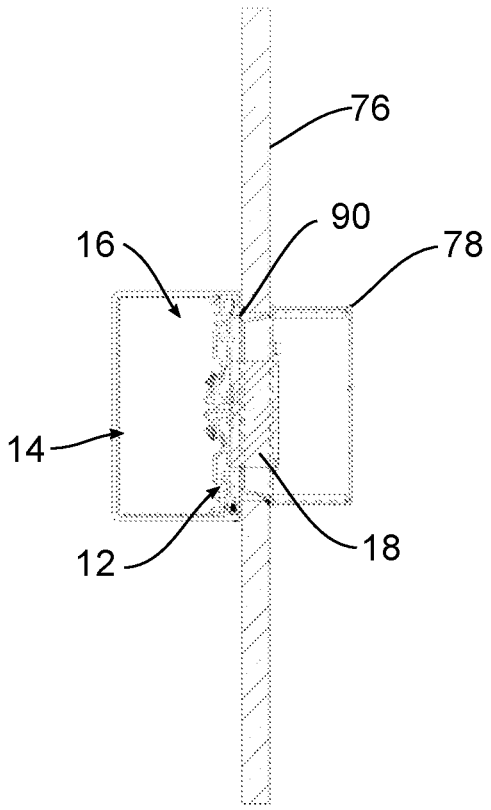
FIG. 12 is a side view of the light fixture and recessed mount of FIG. 11 installed in a wall.

FIGS. 11 and 12 show another exemplary embodiment of a mounting assembly that utilizes a recessed mount 90 with a lower profile than the surface mount 70 which extends from a surface to provide extra space for connections and components. The recessed mount 90 has a base 92 and a central opening 94 that can allow conductors to be passed through the base 92. The base 92 also includes a plurality of mounting openings 96 that facilitate connecting the recessed mount 90 to a surface 76 such as a wall or wall stud.

A top flange 98 and a bottom flange 100 extend form the base 92. Both the top and bottom flanges 98, 100 can have a substantially L-shaped configuration with a free end facing upward. The top flange 98 extends into the rear upper channel 42. The bottom flange 86 extends into the inner rear lower channel 46B. During installation, the recessed mount 90 can be connected to a surface 76, with the central opening 94 aligned with the opening of a junction box 78 or otherwise providing access to a power supply. After the recessed mount 90 is secured to the surface 76, electrical connections can be made and the body 12 can be engaged with the recessed mount 90 by hanging the rear upper channel 42 and the inner rear lower channel 46B from the top flange 98 and the bottom flange 100 respectively. A fastener can then be inserted through the recessed mount 90 and into the outer rear lower channel 46A. When connected, the driver compartment 18 will extend through the central opening 92 in the recessed mount 90.

Figure 13:
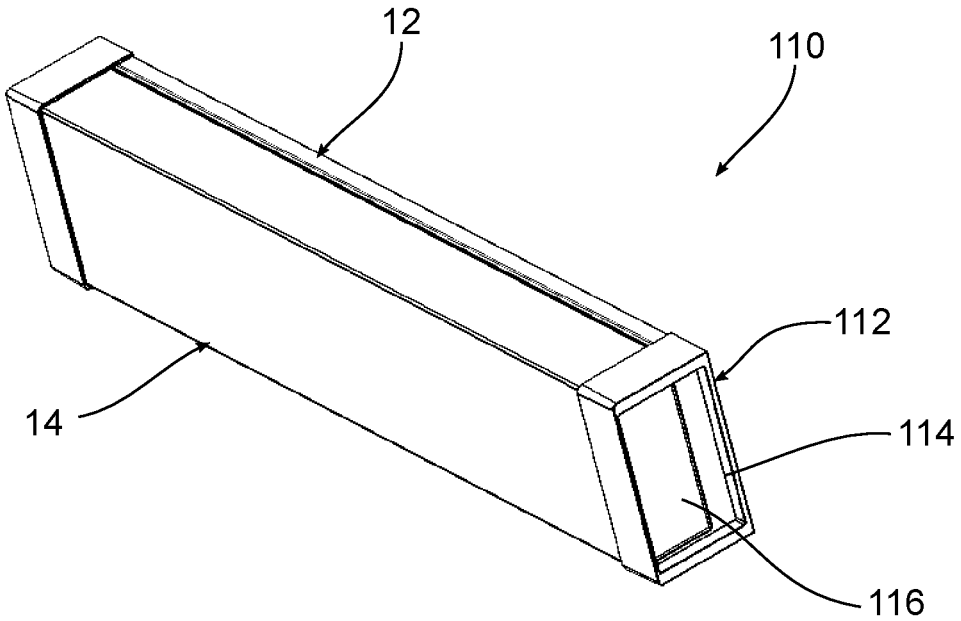
FIG. 13 is a front perspective view of a light fixture with end caps having a frame and a side lens.

According to various exemplary embodiments, different type of lenses and end caps can be connected to form light fixtures having different light outputs. For example, FIG. 13 shows a light fixture 110 utilizing the body 12, a lens 14, and end caps 112 having an outer frame 114 and a side lens 116. The side lens 116 allows light to diffuse from the ends of the light fixture 110 as well as from the front, top, and bottom.

Figure 14:
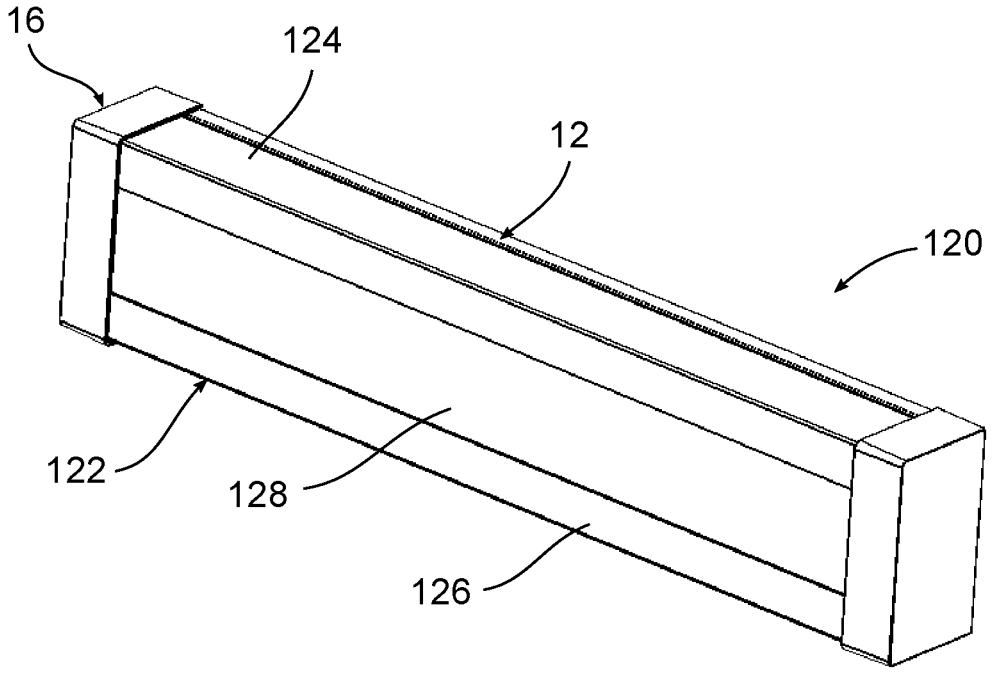
FIG. 14 is a front perspective view of a light fixture having a divided lens and a panel.
Figure 15:
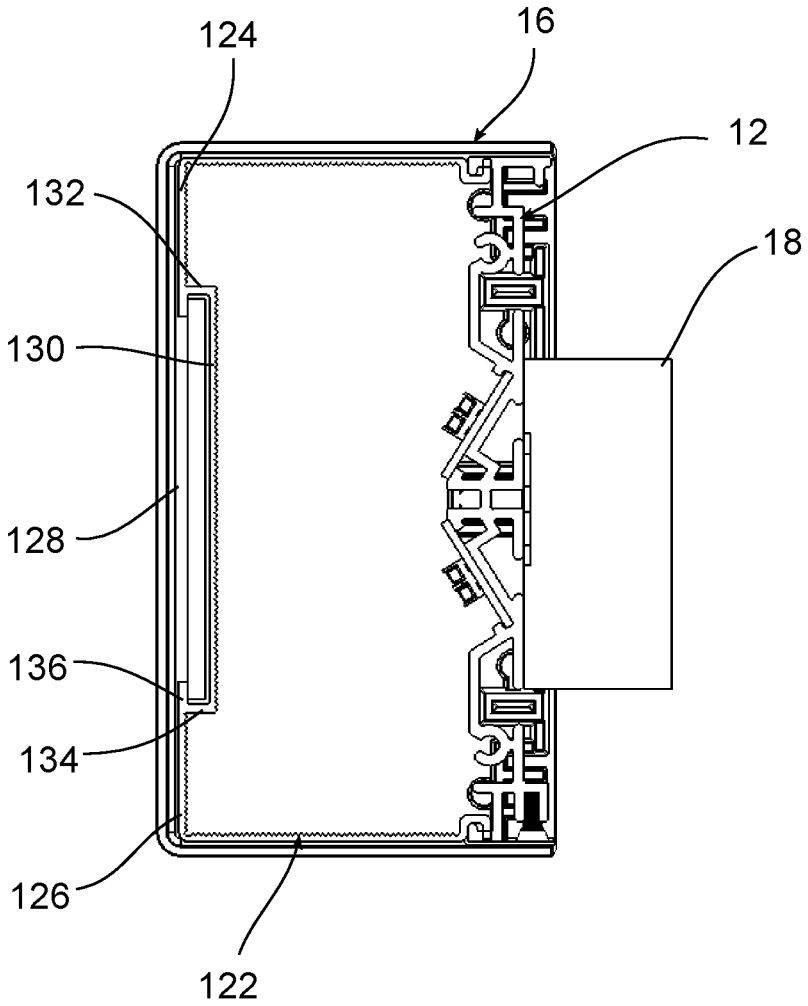
FIG. 15 is a side view of the light fixture of FIG. 14 with one of the end caps removed.

FIGS. 14 and 15 show a light fixture 120 utilizing a divided lens 122 connected to the body 12. The divided lens 122 has an upper section 124, a lower section 126, and a front portion that receives a panel 128. The upper and lower sections 124, 126 can include optical features, such as serrations or prisms, to provide different light diffusion. The panel 128 is configured to have a light output different from the remainder of the lens 122, for example by having a different distribution, color, or design effect. The panel 128 can have any combination of different light diffusion or opacity, the panel 128 can be tinted a different color, and the panel 128 can also contain a pattern, decoration, logo, or other indicia or graphics. As best shown in FIG. 15, the divided lens 122 includes a channel to receive the panel 128. The channel is defined by a rear wall 130, an upper wall 132, a lower wall 134, and an upper and lower flange 136. The rear wall 130 includes optical features, such as serrations or prisms, to provide different light diffusion. Different panels 128 can be selectively inserted into the channel as desired.

Figure 16:
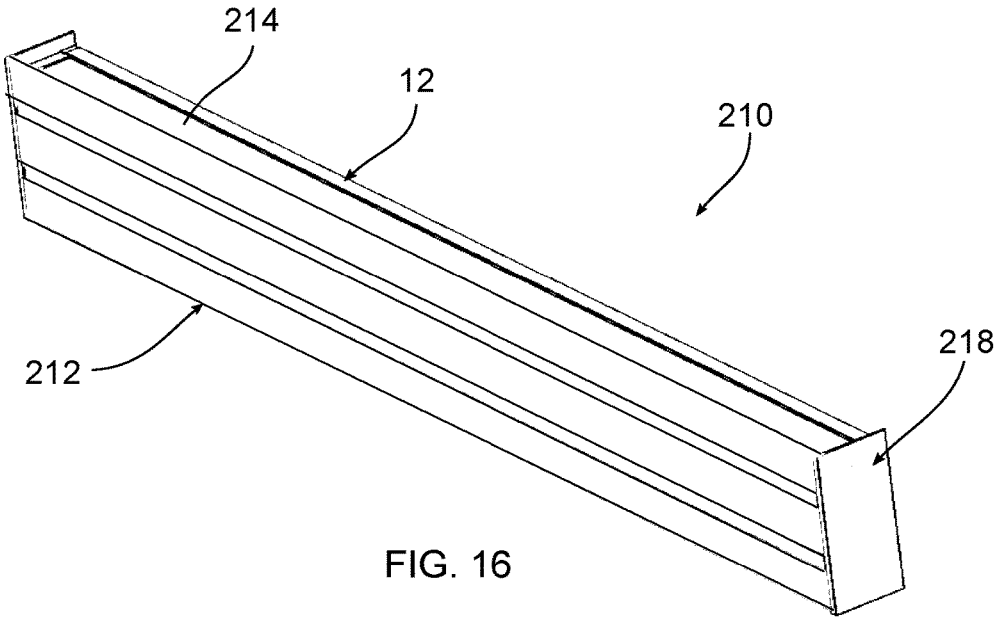
FIG. 16 is a front perspective view of another light fixture having a straight lens, a top lens, and a bottom lens.
Figure 17:
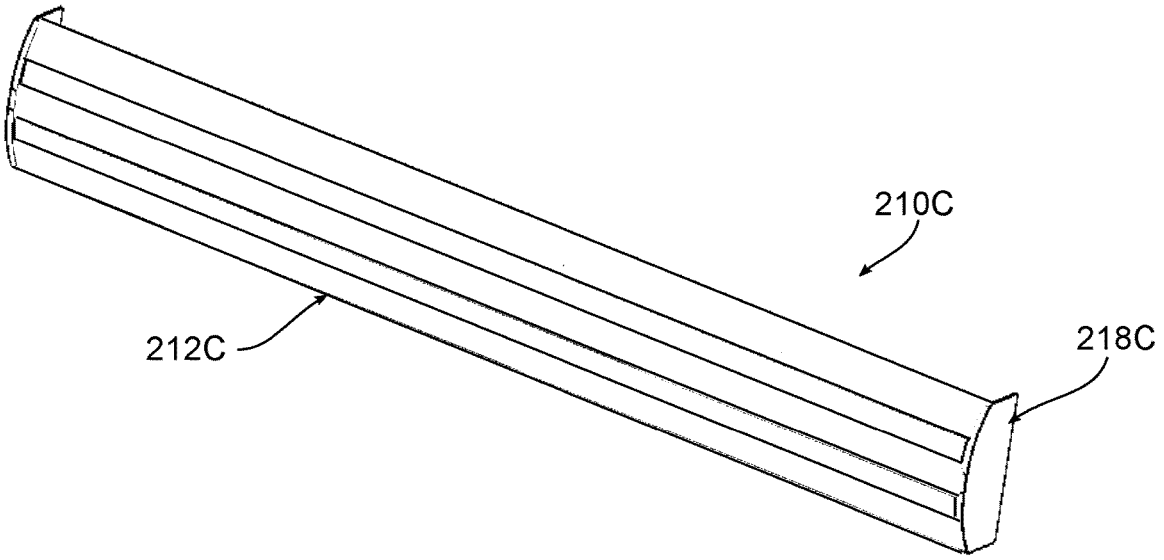
FIG. 17 is a front perspective view of the light fixture of FIG. 16 having a curved lens and curved end caps.
Figure 18:
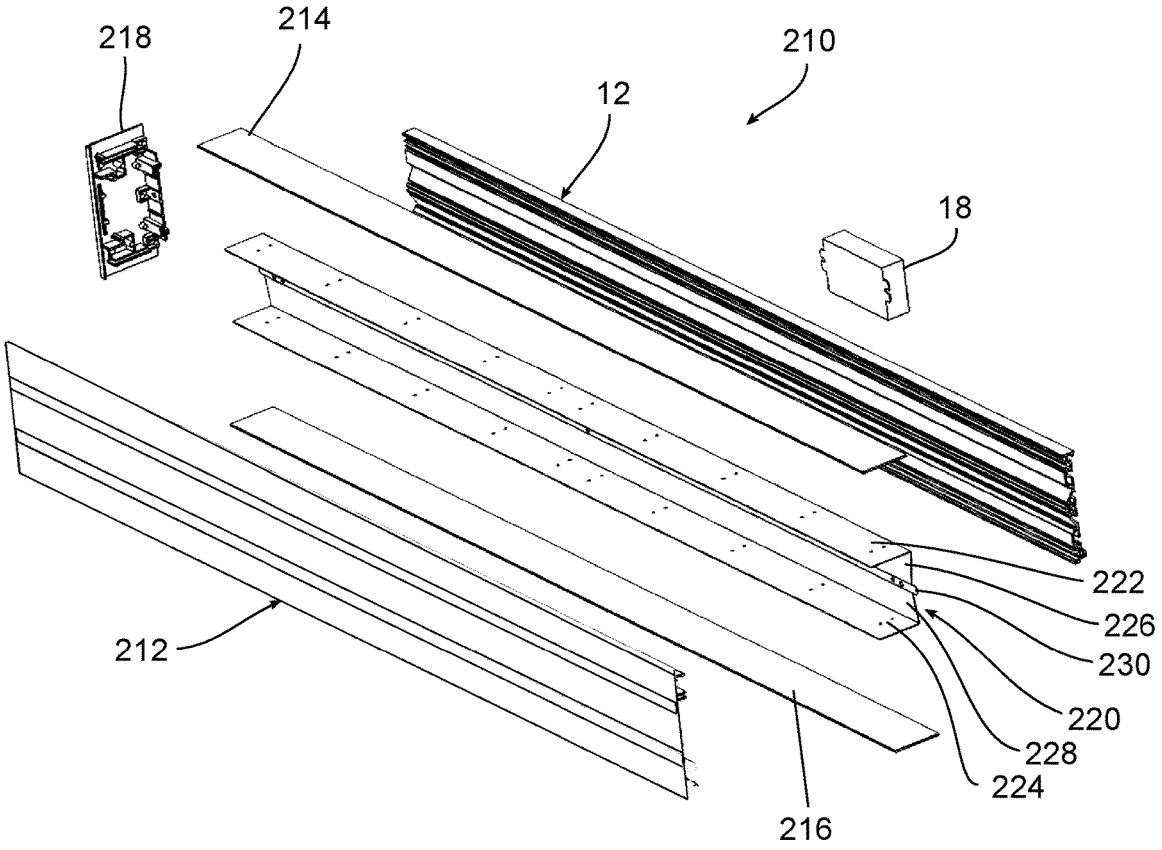
FIG. 18 is an exploded view of the light fixture of FIG. 16.

FIGS. 16 and 18 shows an exemplary embodiment of a light fixture 210 that utilizes a body 12, a straight lens 212, a top lens 214, a bottom lens 216, and a pair of straight end caps 218. FIG. 17 shows an exemplary embodiment of a light fixture substantially similar to the one shown in FIG. 16 except having a curved lens 212C and curved end caps 218C. Accordingly, only the straight lens 212 light fixture 210 is substantially described and similar parts for the curved lens 212C are shown in the drawings with a "C" designation. In some embodiments, the straight lens 212 and the curved lens 212C have one or more portions with optical features, such as prisms or serrations, to diffuse light. Different portions of the lenses 212, 212C can have different optical features and therefore different light outputs. Portions of the lenses 212, 212C can also prevent light transmission. The top lens 214 and the bottom lens 216 can also include optical features such as prisms or serrations to diffuse light.

As best shown in FIG. 18, the interior of the light fixture 210 includes a mounting bracket 220 that can be connected to the front of the body 12. The mounting bracket can include an upper section 222 and a lower section 224 configured to receive one or more light emitters, such as one or more light boards comprising LEDs connected to a PCB. An upper rear wall 226 extends from the upper section 222 and a lower rear wall 228 extends from the lower section 224. A central section 230 is positioned between the upper rear wall 226 and the lower rear wall 228. The central section 230 can include a plurality of apertures that are configured to receive fasteners that are used to connect the mounting bracket 220 to the body 12. The fasteners can extend through the mounting bracket 220 and into the front channel 22 of the body 12.

Figure 19:
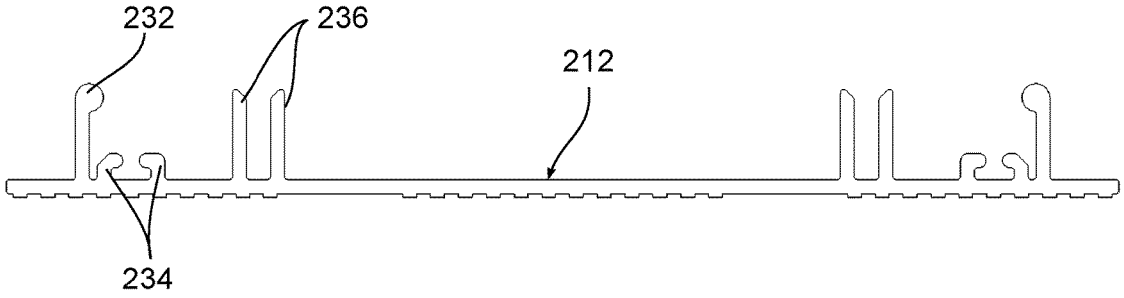
FIG. 19 is a side view of the straight lens of FIG. 16.
Figure 20:
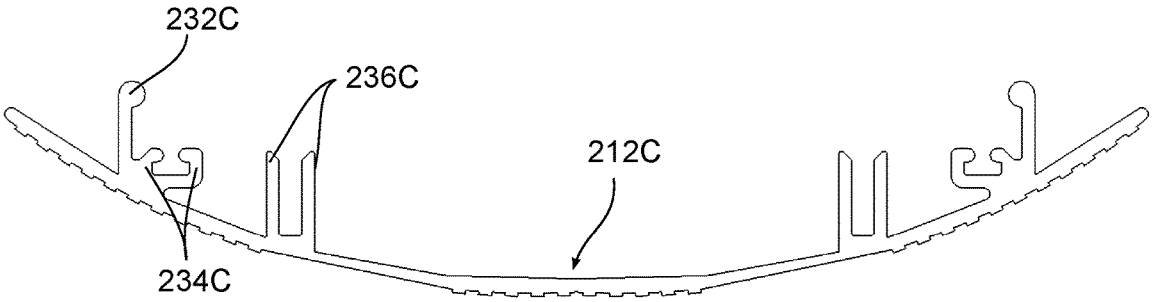
FIG. 20 is a side view of the curved lens of FIG. 17.

FIG. 19 shows an exemplary embodiment of the straight lens 212 and FIG. 20 shows an exemplary embodiment of the curved lens 212C. The lens 212 includes an outer surface having a plurality of optical features. A plurality of protrusions extend from the inner surface to the interior of the light fixture 210 to provide connections for various components. In an exemplary embodiment, a first protrusion 232 includes an enlarged end portion for forming a snap-fit connection with the end cap. A set of second protrusions 234 define a first channel that receives the top lens 214. A set of third protrusions 236 define a second channel that receives the upper section 222 of the mounting bracket 220 and a portion of the end cap 218. As shown, a lower half of the front lens includes symmetrical features, although other configurations can be used. In some embodiments the lens 212 can be a cover that prevents the transmission of light through the front of the housing.

Figure 21:
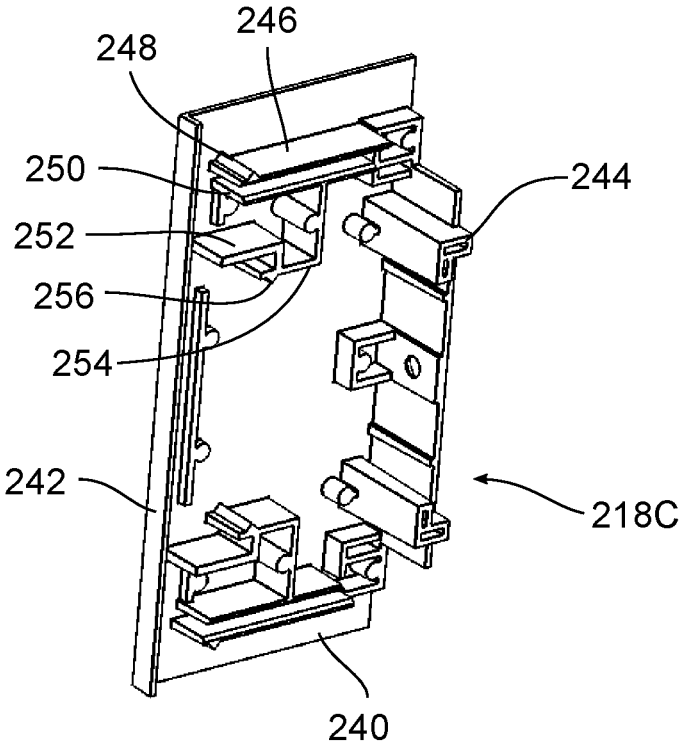
FIG. 21 is a side perspective view of the end caps of FIG. 16.
Figure 22:
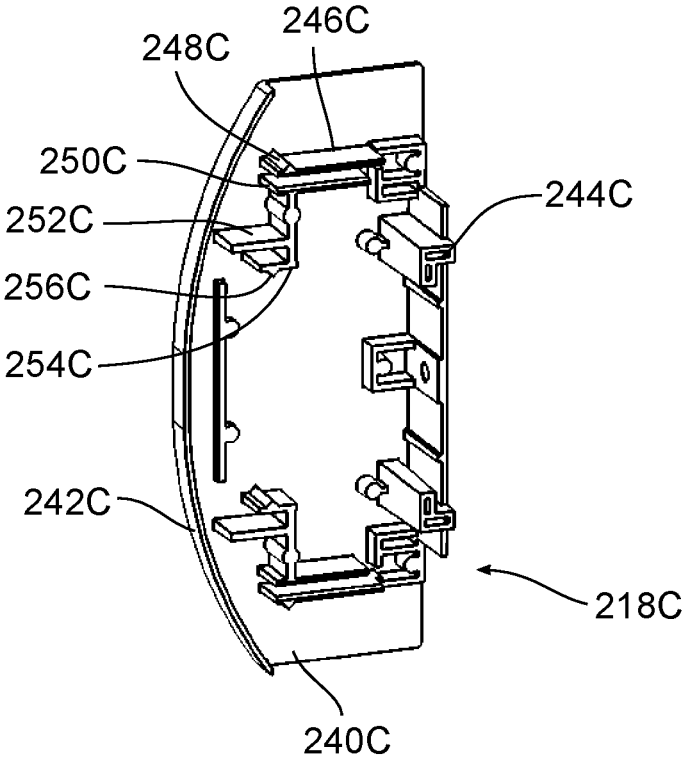
FIG. 22 is a side perspective view of the end caps of FIG. 17.

FIG. 21 shows an exemplary embodiment of a straight end cap 218 and FIG. 22 shows an exemplary embodiment of a curved end cap 218C. The end cap includes a side wall 240, a front flange 242, and a plurality of protrusions that extend from the side wall 240 and mate with different component of the light fixture 210. An L-shaped projection 244 is configured to mate with the mid channel 40 of the body 12. A first lens projection 246 includes a first protrusion 248 for engaging with the enlarged portion of the lens first protrusion 232. The first lens projection 246 and a second lens projection 250 define a cavity that receives the top lens 214. A third lens projection 252 is configured to extend into the channel defined by the set of third lens protrusions 236. A fourth lens projection 254 includes a second protrusion 256 that is configured to connect to, for example, a split lens 312 as discussed below. As shown, a lower half of the end cap 218 includes symmetrical features, although other configurations can be used. In an exemplary embodiment the end caps 218 are connected to the lens 212 and the body 12 through a snap fit and/or interference fit connections. In some embodiments, a single fastener can be used to secure the end cap 218 to the body 12, for example connecting to the center rear channel 36.

Figure 23:
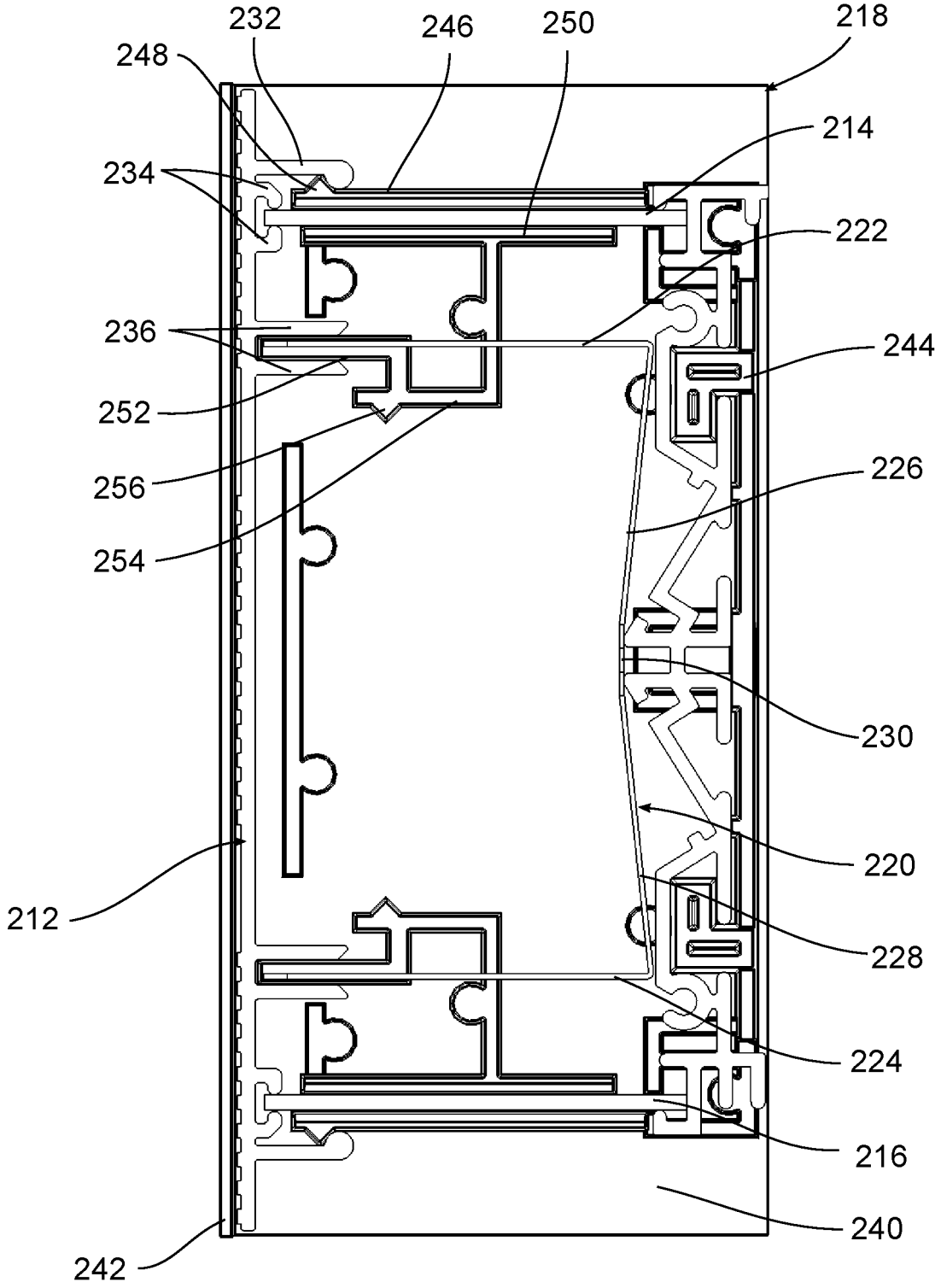
FIG. 23 is a side view of the light fixture of FIG. 16 with one of the end caps removed.
Figure 24:
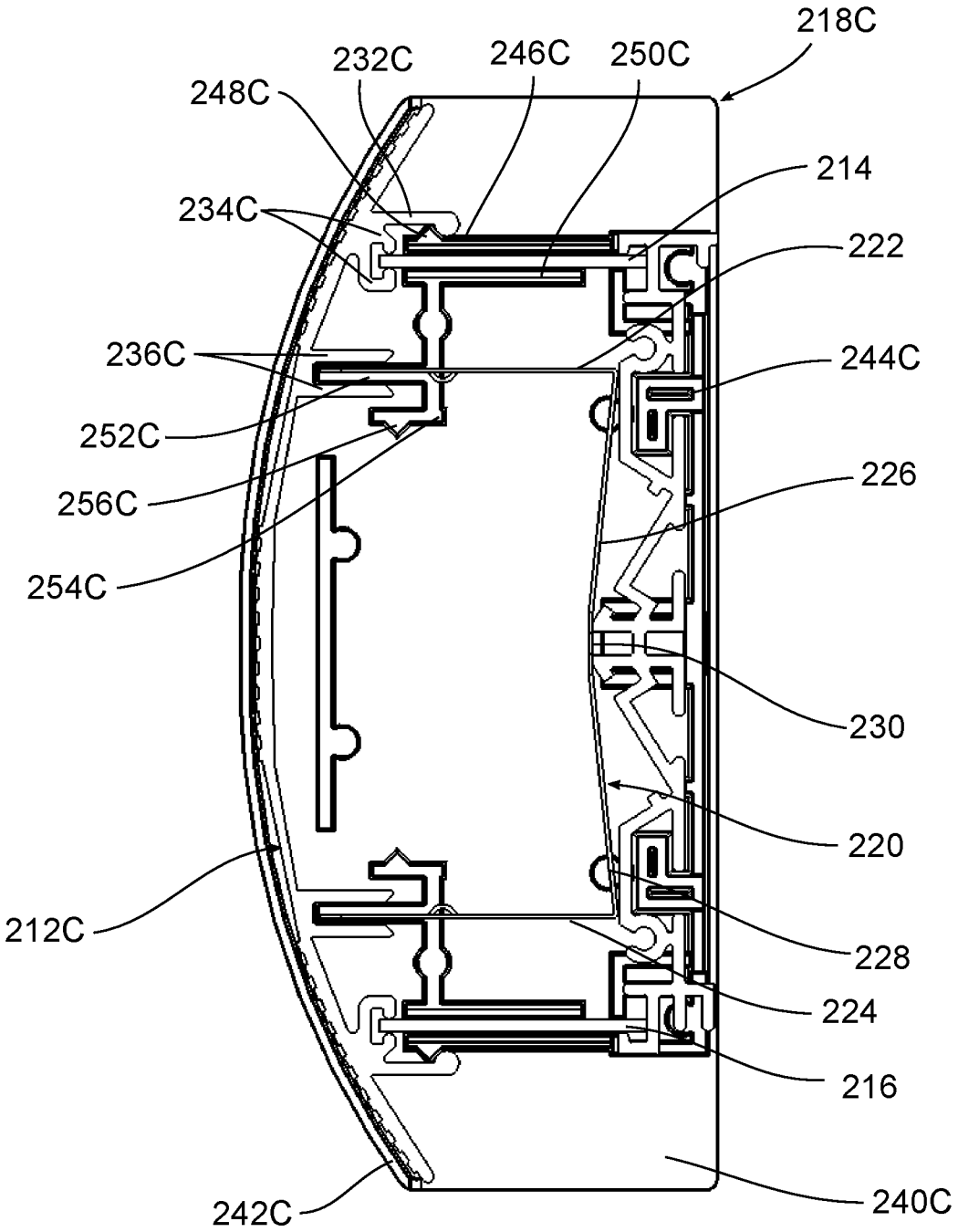
FIG. 24 is a side view of the light fixture of FIG. 17 with one of the end caps removed.

FIGS. 23 and 24 show the light fixtures 210, 210C with one of the end caps 218, 218C removed showing the different connection features described above. A driver compartment 18 can be connected to the light fixtures 210, 210C. The light fixtures 210, 210C can also be mounted using a surface mount 70 or a recessed mount 90 as described above.

Figure 25:
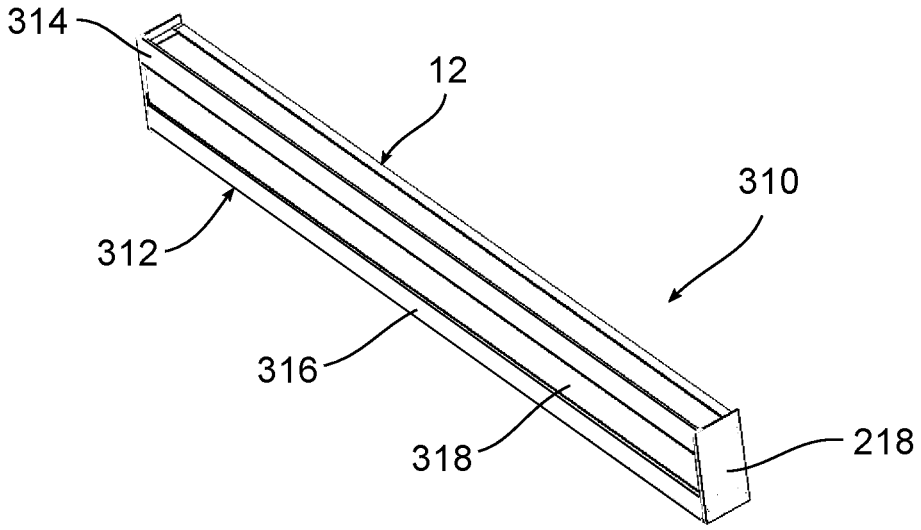
FIG. 25 is a front perspective view of a light fixture having a split lens.
Figure 26:
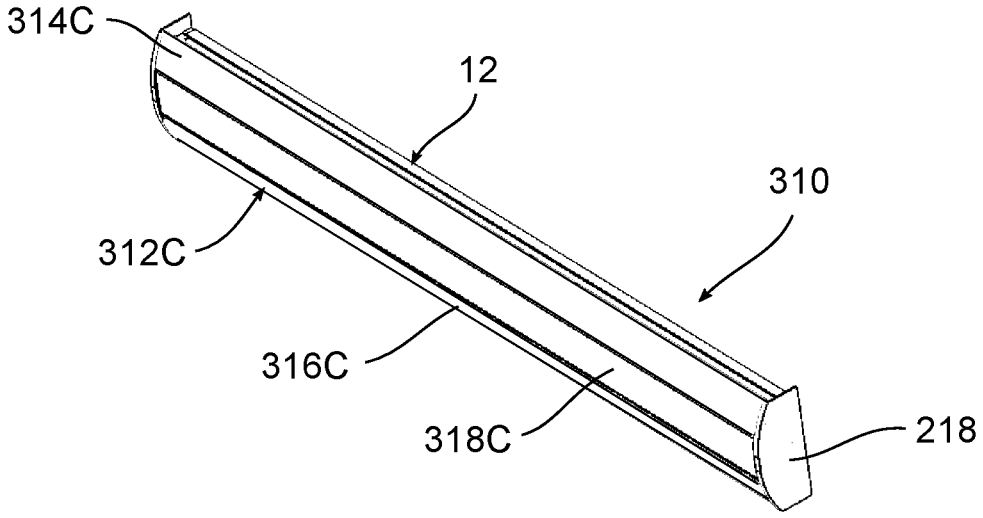
FIG. 26 is a front perspective view of a light fixture having a curved split lens.

FIG. 25 shows an exemplary embodiment of a light fixture 310 that utilizes a straight split lens 312 and FIG. 26 shows an exemplary embodiment of a light fixture 310C that utilizes a curved split lens 312C. The lenses 312, 312C can be used with the body 12, top lens 214, bottom lens 216, and end caps 218, 218C as discussed above. Accordingly, only the straight split lens 312 is substantially described and similar parts for the curved split lens 312C are shown in the drawings with a "C" designation.

Figure 28:
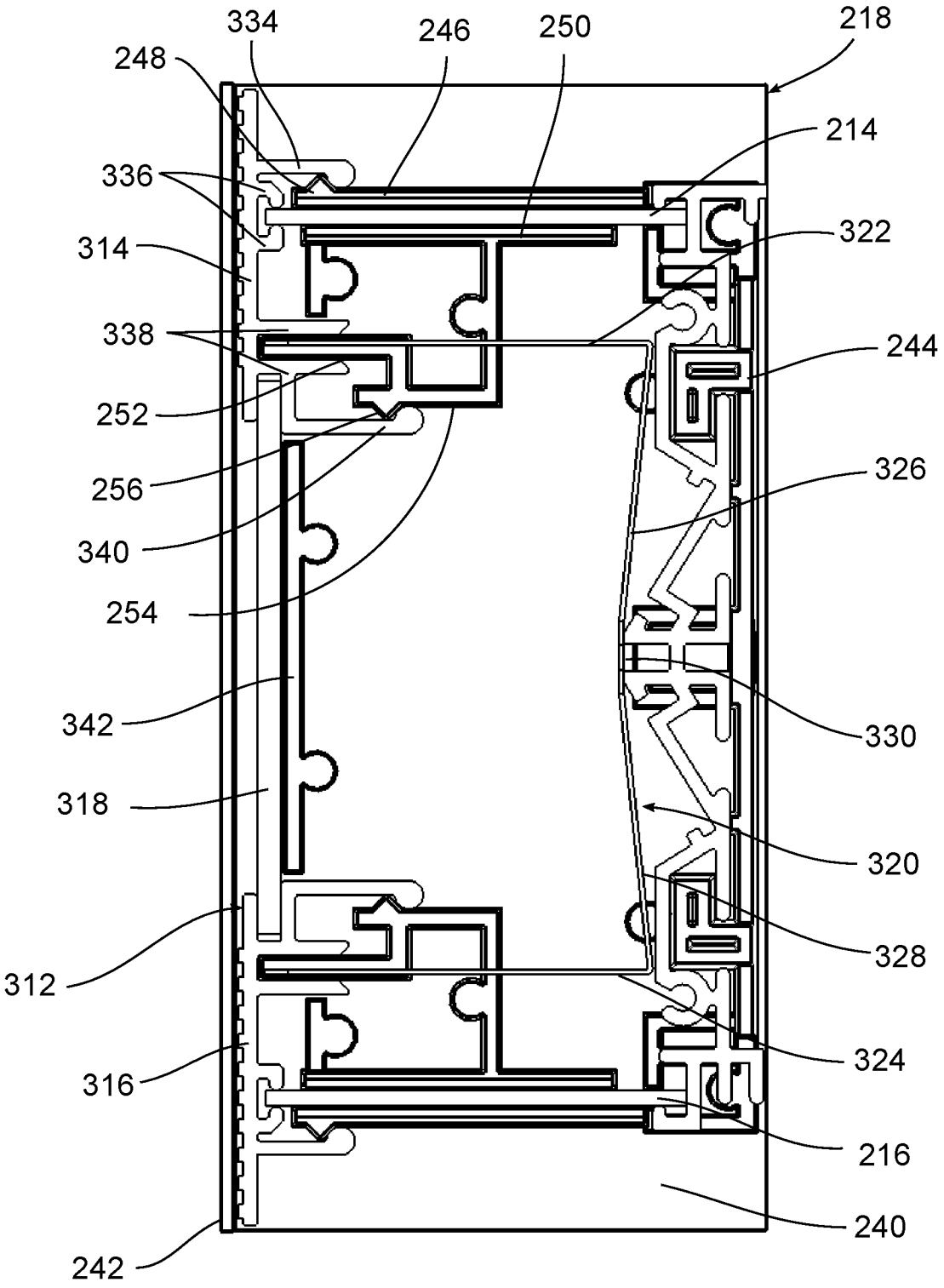
FIG. 28 is a side view of the light fixture of FIG. 25 with one of the end caps removed.
Figure 29:
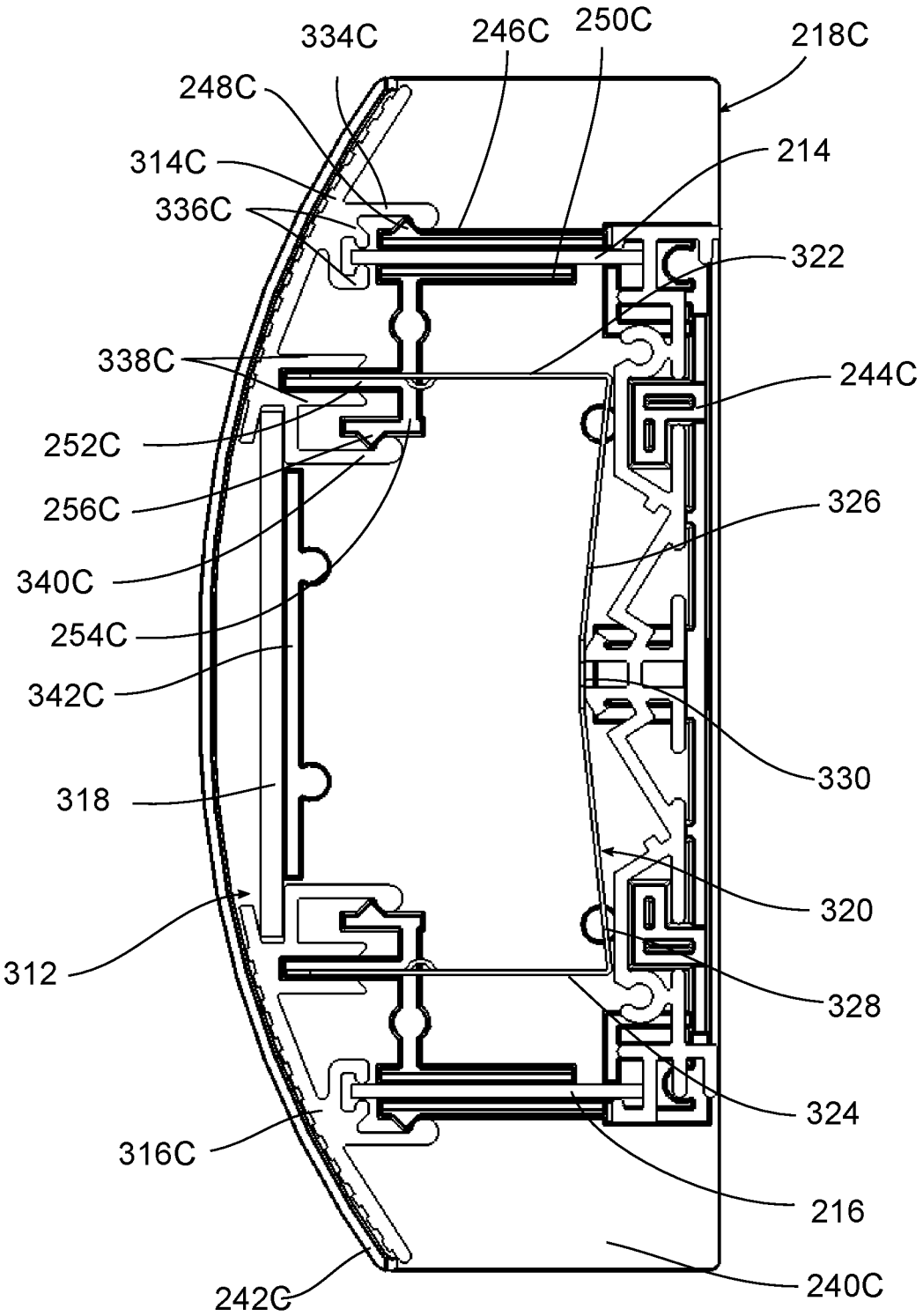
FIG. 29 is a side view of the light fixture of FIG. 26 with one of the end caps removed.

The split lens 312 includes an upper section 314, a lower section 316, and a panel 318 positioned between the upper section 314 and the lower section 316. As best shown in FIGS. 28 and 29, the upper section 314 and the lower section 316 can be discrete parts, separated from one another with each section 314, 316 independently connected to the end caps 218. The upper and lower portions 314, 316 can include optical features, such as serrations or prisms, to provide different light diffusion. The panel 318 is configured to have a light output different from the remainder of the lens 312, for example by having a different distribution, color, or design effect. The panel 318 can have any combination of different light diffusion or opacity, the panel 318 can be tinted a different color, and the panel 318 can also contain a pattern, decoration, logo, or other indicia or graphics. In some embodiments, the straight lens 312 and the curved lens 312C have one or more portions with optical features, such as prisms or serrations, to diffuse light. Portions of the lenses 312, 312C can also prevent light transmission.

Figure 27:
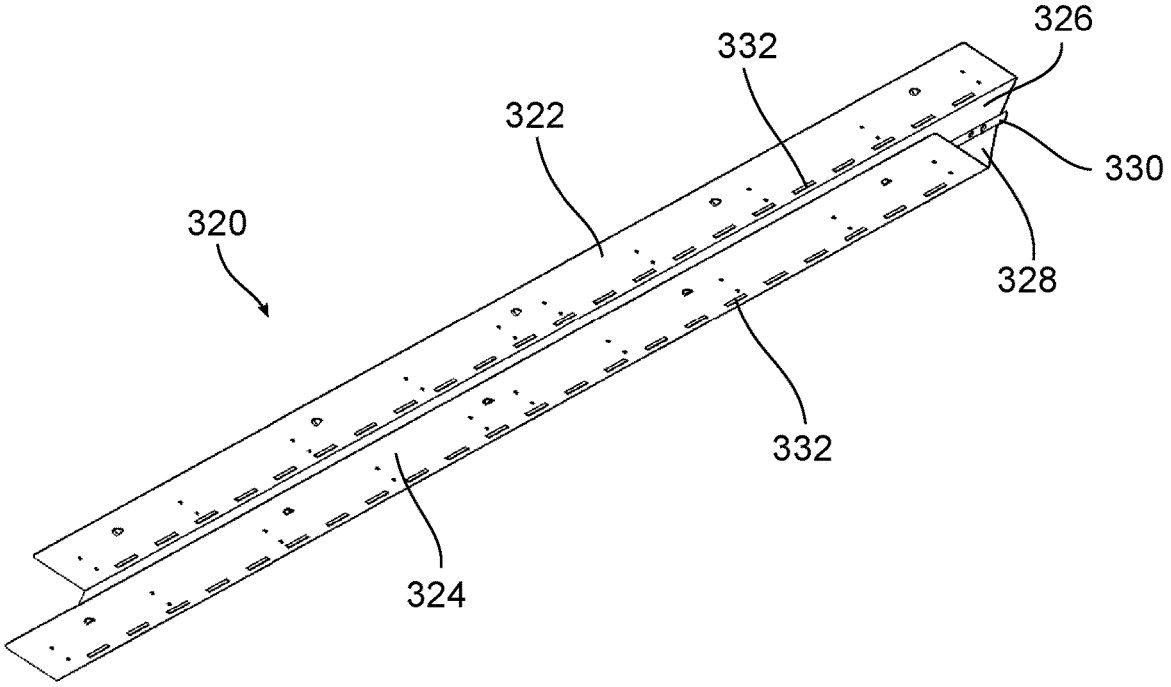
FIG. 27 is a bottom perspective view of a mounting bracket used with the light fixtures of FIGS. 25 and 26.

FIG. 27 shows an exemplary embodiment of a mounting bracket 320 that can be connected to the front of the body 12 and used with the split lenses 312, 312C. The mounting bracket can include an upper section 322 and a lower section 324 configured to receive one or more light emitters, such as one or more light boards comprising LEDs connected to a PCB. An upper rear wall 326 extends from the upper section 322 and a lower rear wall 328 extends from the lower section 324. A central section 330 is positioned between the upper rear wall 326 and the lower rear wall 328. The central section 330 can include a plurality of apertures that are configured to receive fasteners that are used to connect the mounting bracket 320 to the body 12. The fasteners can extend through the mounting bracket 320 and into the front channel 22 of the body 12.

As shown in FIG. 27, the mounting bracket 320 upper and lower sections 322, 324 include a plurality of slots 332. As discussed above, light emitters are connected to the upper section 322 and the lower section 324 to emit light through the top lens 214 and the bottom lens 216 as well as the front lens 312. When light is being emitted inside of the light fixture 310, it will reflect off the different surfaces and interior components and be transmitted through the slots 332. After being transmitted through the slots 332, the light can continue to reflect off of the interior surfaces of the mounting bracket, with at least a portion of the light being emitted through the split lens 312.

As best shown in FIG. 28, the upper section 314 of the lens 312 includes an outer surface having a plurality of optical features. A plurality of protrusions extend from the inner surface to the interior of the light fixture 310 to provide connections for various components. In an exemplary embodiment, a first protrusion 334 includes an enlarged end portion for engaging the end cap 218 to form a snap-fit, resilient, or interference fit type connection. A set of second protrusions 336 define a first channel that receives the top lens 214. A set of third protrusions 338 define a second channel that receives the upper section 322 of the mounting bracket 320 and a portion of the end cap 218. A fourth protrusion 340 includes an enlarged end portion for engaging the end cap 218 to form a snap-fit, resilient, or interference fit type connection. The fourth protrusion 340 also partially defines a channel for receiving the panel 318. As shown, a lower section 314 of the lens 312 includes symmetrical features, although other configurations can be used. As also shown in FIG. 28, the end cap 218 includes a central projection 342 that can help support the panel 318. The light fixtures 310, 310C can also be mounted using a surface mount 70 or a recessed mount 90 as described above. Different connecting features can also be used to connect the different components.

Various exemplary embodiments are directed to methods of selecting, assembling, and manufacturing the different components described above. The use of these components provides essential base components to create an extremely varied product line. In this manner, different light fixtures can be created for different users using similar inventory components.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A wall mounted light fixture comprising:

a body at least partially defining a housing, the body having a first side facing an interior of the housing and a second side facing the exterior of the housing, the first side of the body having a plurality of front connecting features and the second side of the body having a plurality of rear connecting features;

a light emitter positioned in the interior of the housing and supported by the first side of the body;

a lens connected to at least one of the front connecting features; and a mounting component connected to at least one of the rear connecting features.

2. The light fixture of claim 1, wherein the mounting component includes a surface mount.

3. The light fixture of claim 2, wherein the surface mount includes a top flange and a bottom flange, and wherein the rear connecting features include an upper channel for receiving the top flange and a lower channel for receiving the bottom flange.

4. The light fixture of claim 1, wherein the mounting component includes a recessed mount.

5. The light fixture of claim 4, wherein the recessed mount includes a top flange and a bottom flange, and wherein the rear connecting features include an upper channel for receiving the top flange and a lower channel for receiving the bottom flange.

6. The light fixture of claim 1, wherein the lens includes an upper lens hook and a lower lens hook, and wherein the front connecting features include an upper channel for receiving the upper lens hook and a lower channel for receiving the lower lens hook.

7. The light fixture of claim 1, further comprising a driver compartment connected to at least one of the rear connecting features.

8. The light fixture of claim 1, wherein the lens includes a removable panel and the light emitter is supported by a mounting bracket connected to the body.

9. A wall mounted light fixture comprising:

a body at least partially defining a housing, the body having a first side facing an interior of the housing and a second side facing the exterior of the housing, the first side of the body having a plurality of front connecting features and the second side of the body having a plurality of rear connecting features;

a mounting bracket connected to at least one of the front connecting features;

a light emitter connected to the mounting bracket;

an end cap connected to the body; and a front lens connected to the end cap and positioned substantially opposite from the body.

10. The light fixture of claim 9, wherein the light emitter is one of a first light emitter or a second light emitter, and wherein the mounting bracket includes a upper section extending between the body and the front lens for supporting the first light emitter substantially perpendicular to the front lens, and a lower section extending between the body and the front lens for supporting the second light emitter substantially perpendicular to the front lens.

11. The light fixture of claim 10, wherein the upper section and the lower section each include a plurality of slots configured to receive light emitted from the first and second light emitters, respectively.

12. The light fixture of claim 11, wherein at least a portion of the light received by the slots is reflected by the mounting bracket and emitted through the front lens.

13. The light fixture of claim 9, further comprising a top lens connected to the front lens and the endcap and a bottom lens connected to the body, the front lens, and the endcap.

14. The light fixture of claim 13, wherein the front lens includes a first protrusion engaging a portion of the end cap, a first channel defined by a set of second protrusions receiving the top lens, and a second channel defined by a set of third protrusions receiving a portion of the mounting bracket and a portion of the end cap.

15. The light fixture of claim 14, wherein the lens includes a removable panel.

16. A wall mounted light fixture comprising:

a body at least partially defining a housing, the body having a first side facing an interior of the housing and a second side facing the exterior of the housing, the first side of the body having a plurality of front connecting features and the second side of the body having a plurality of rear connecting features;

a light emitter positioned in the interior of the housing and supported by the first side of the body;

an end cap connected to the body; and a front lens connected to the end cap and positioned substantially opposite from the body, the front lens including an upper section, a lower section, and a panel removably positioned between the upper section and the lower section.

17. The light fixture of claim 16, wherein the panel is received in a channel defined by a rear wall, an upper wall, a lower wall, an upper flange and a lower flange.

18. The light fixture of claim 16, wherein the panel is received in a first channel defined by the upper section of the lens and a second channel defined by the lower section of the lens.

19. The light fixture of claim 16, wherein the panel produces a different light output from the upper section and the lower section.

20. The light fixture of claim 16, further comprising a mounting bracket supporting the light emitter, wherein the mounting bracket includes a slot for receiving light emitted from the light emitter and wherein at least a portion of the light received by the slot is reflected by the mounting bracket and emitted through the panel.

* * * * *